US006406650B1

(12) United States Patent
Gross et al.

(10) Patent No.: US 6,406,650 B1
(45) Date of Patent: Jun. 18, 2002

(54) YARN MELT SPINNING APPARATUS AND METHOD

(75) Inventors: Hans-Rochus Gross, Bergisch Gladbach; Jorg Hegenbarth, Remscheid; Frank Bäcker, Solingen, all of (DE)

(73) Assignee: Barmag AG, Remscheid (DE)

( * ) Notice: Subject to any disclaimer, the term of this patent is extended or adjusted under 35 U.S.C. 154(b) by 0 days.

(21) Appl. No.: 09/523,544

(22) Filed: Mar. 10, 2000

(30) Foreign Application Priority Data

Mar. 10, 1999 (DE) ..... 199 10 437

(51) Int. Cl.[7] ..... D01D 4/06; D01D 5/08; D02G 3/00; D02J 1/08

(52) U.S. Cl. ..... 264/103; 28/247; 28/271; 264/211.12; 425/382.2; 425/463

(58) Field of Search ..... 264/78, 103, 211.12; 425/131.5, 382.2, 463; 28/220, 221, 247, 271

(56) References Cited

U.S. PATENT DOCUMENTS 4,001,369 A * 1/1977 Shah ..... 264/103 X
5,251,363 A 10/1993 Gerhards et al.
5,887,323 A 3/1999 Beifuss et al.

FOREIGN PATENT DOCUMENTS

EP 0 485 871 B1 2/1995
JP 04185707 A * 7/1992 ..... 264/211.12

* cited by examiner

*Primary Examiner*—Leo B. Tentoni
(74) *Attorney, Agent, or Firm*—Alston & Bird LLP

(57) ABSTRACT

A spinning apparatus for producing a plurality of yarns, wherein the yarns are produced by combining a plurality of filament bundles. To this end, the spinning apparatus includes a plurality of extruders for producing a plurality of melt flows, which are distributed by a plurality of distributor pumps to at least two spinning positions that are arranged side by side. Each of the spinning positions includes a plurality of spinnerets, which extrude a partial flow from a distributor pump to a filament bundle. Also, the spinning positions are arranged so that at least one filament bundle of one spinning position can be combined to a yarn with at least one filament bundle of an adjacent spinning position.

18 Claims, 4 Drawing Sheets

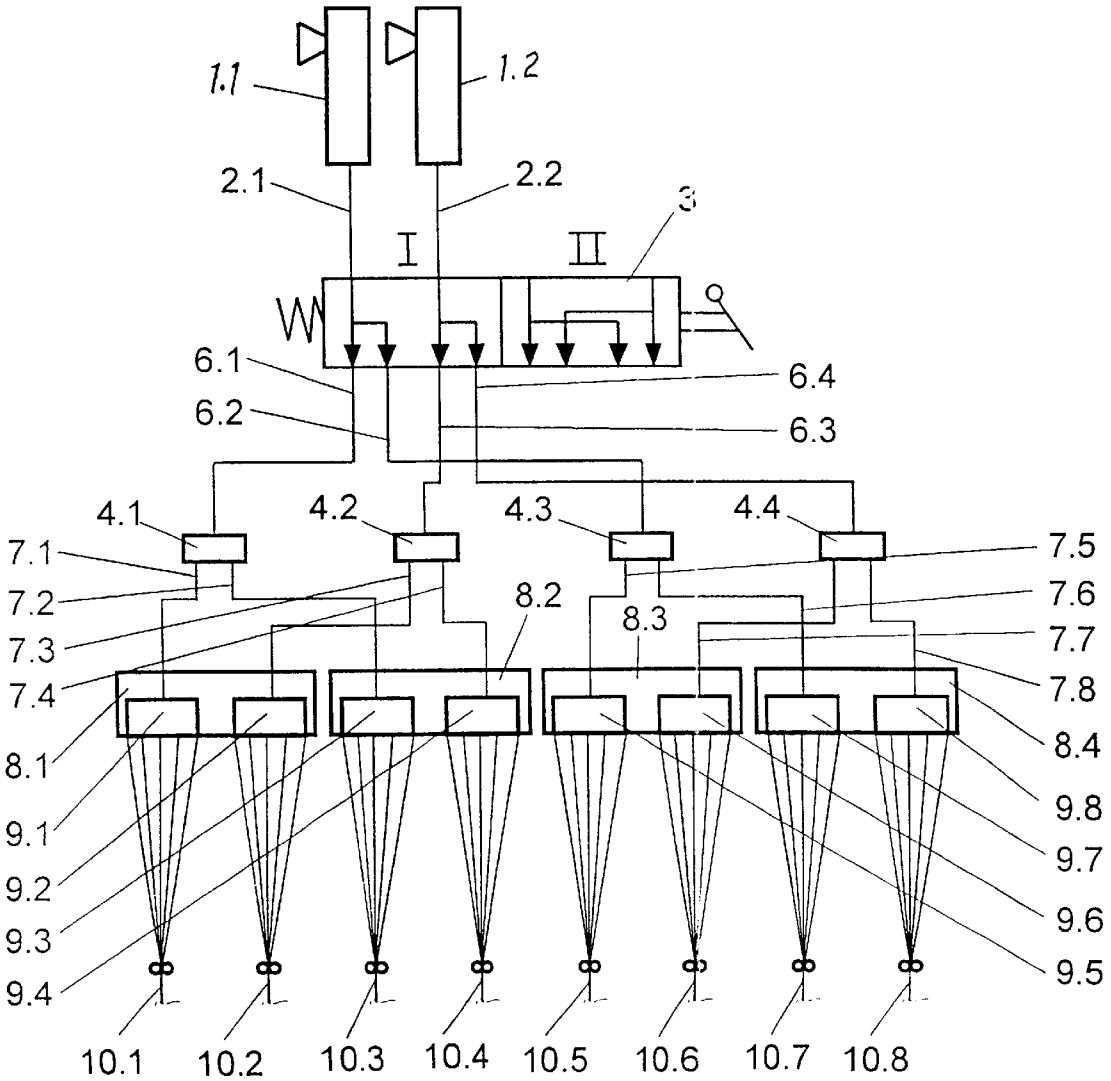
Fig.3.1

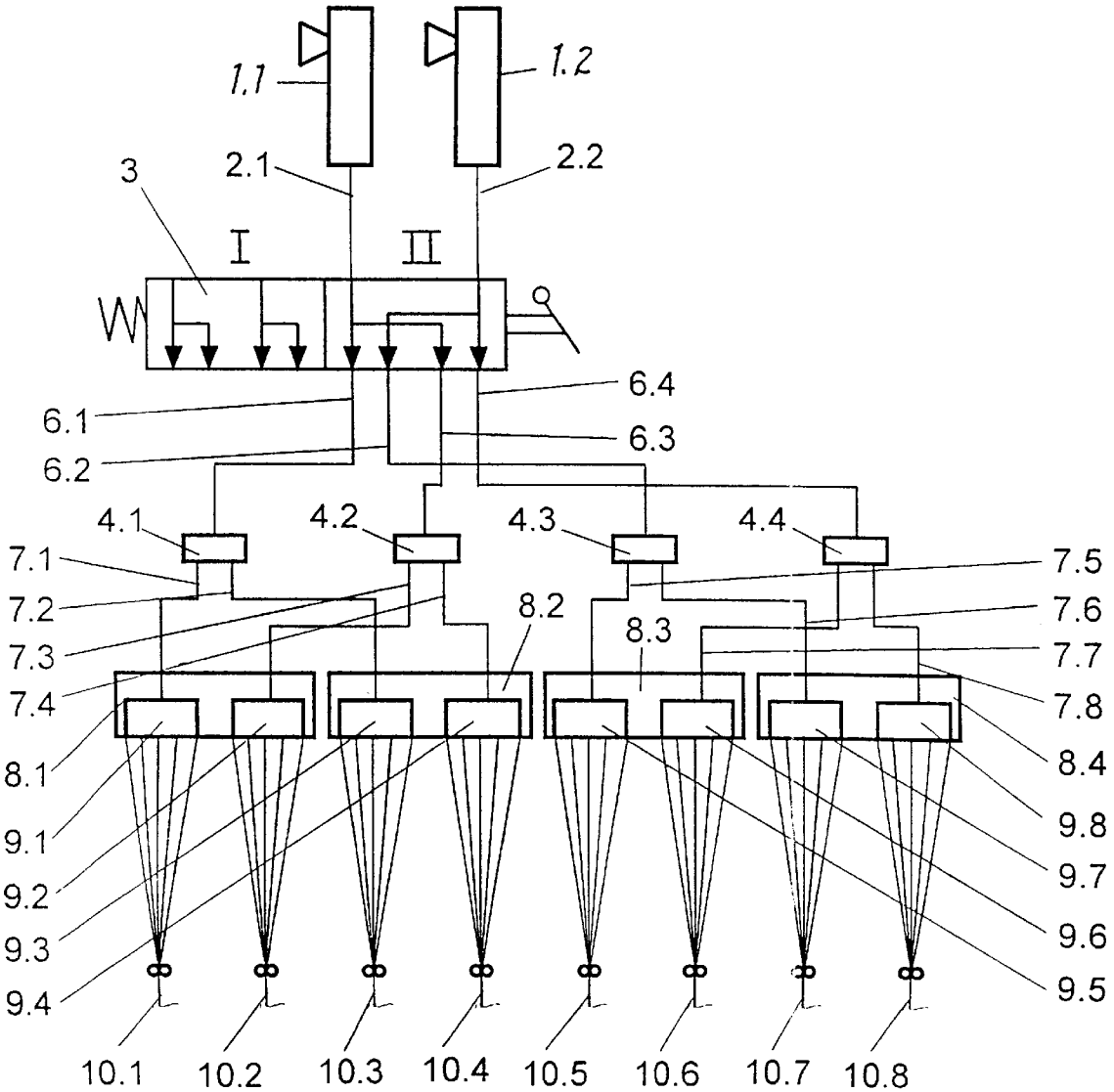
Fig.3.2

YARN MELT SPINNING APPARATUS AND METHOD

BACKGROUND OF THE INVENTION

The present invention relates to a melt spinning apparatus for producing a plurality of yarns.

In the production of yarns by melt spinning, one distinguishes between undyed, unicolored, and multicolored yarns, which require different spinning apparatus. In particular in the production of multicolored carpet yarns, apparatus are used, which extrude in one spinning position a plurality. of filament bundles and subsequently combine these filament bundles to a yarn. Such apparatus is described, for example, in EP 0485871 and corresponding U.S. Pat. No. 5,251,363. In the known apparatus, an extruder produces a corresponding melt flow for each color. For each color, the spinning position produces one filament bundle, with all filament bundles being combined to the multicolored yarn. Thus, a plurality of extruders are associated to the spinning position. In practice, a plurality of spinning positions are arranged side by side. In this arrangement, the melt flows of the extruders are distributed to the individual spinning positions by a plurality of distributor pumps. Depending on the design of the distributor pump, one distributor pump supplies a plurality of spinnerets at the same time. These spinnerets are associated respectively to one spinning position. Such spinning apparatus are thus laid out according to the number of the dyes used for the production of a multicolored yarn per spinning position.

However, in practice, it is desired to produce with such a spinning apparatus also unicolored yarns. Yet is it known, that unicolored yarns have a lower denier than multicolored yarns. Thus, the production of unicolored or undyed yarns with the known apparatus is possible only with a considerably lower output, or even impossible in the case of very low yarn deniers.

Furthermore, it is necessary that all spinning positions connected via the controlled melt flow system produce a yarn of the same color and kind. In particular, in the case of a dye change, high production losses are incurred, until all spinning positions connected to the controlled melt flow system are changed to the new dye.

It is therefore the object of the invention to further develop a spinning apparatus of the initially described kind such that it is possible to produce multicolored, unicolored, or undyed yarns with a substantially unchanged output. A further object of the invention is to provide an apparatus with a flexible control of the melt flow and yarn path adapted to the respectively produced yarn.

SUMMARY OF THE INVENTION

The above and other objects and advantages are achieved by the provision of a melt spinning apparatus and method which includes at least one extruder for producing a polymer melt flow, and at least two spinning positions arranged side by side and with each spinning position including at least one spinneret. Also, a distributor system is provided for delivering a portion of the melt flow to each spinneret of each spinning position and such that each spinning position extrudes a filament bundle composed of a plurality of strandlike filaments.

The spinnerets of adjacent spinning positions are arranged side by side in such a manner that at least one filament bundle of the one spinning position can be combined to a yarn with at least one filament bundle of the adjacent spinning position. The special advantage of this configuration lies in that it is possible to vary the number of the filament bundles that are combined to a yarn. Thus, there exists the possibility of combining in the production of a multicolored yarn a larger number of filament bundles to a yarn, and of combining in the production of a unicolored or an undyed yarn a lesser number of filament bundles or only one filament bundle. This permits producing with the same output both a multicolored yarn of a high denier and a unicolored yarn of a low denier. For example, in a spinning apparatus with two spinning positions, which comprise each three spinnerets, it is possible to selectively produce three yarns by combining respectively two adjacent filament bundles, or two yarns by combining three adjacent filament bundles. However, it is also possible to spin, without combining, each filament bundle to one yarn.

Each of the spinning positions comprises a plurality of serially aligned spinnerets and the spinnerets of adjacent spinning positions are serially aligned. This facilitates the production of a plurality of parallel side by side yarns at the same time.

To produce at least one yarn, which is formed by combining two filament bundles of adjacent spinning positions, it is desirable to have the spacing between a spinneret arranged at the edge of the one spinning position and an adjacent spinneret of the other spinning position be the same or insignificantly greater than the spacing between two adjacent spinnerets of one of the spinning positions. This ensures that the spacing between the spinnerets and the converging points of the yarns is the same for each yarn. With that, it is possible to use in like manner yarn guide arrangements of the spinning apparatus both in the production of multicolored yarns and in the production of unicolored yarns.

In the case that a plurality of filament bundles of adjacent spinning positions are combined to a yarn, it will be advantageous when the spacing between two spinnerets of adjacent spinning positions is made smaller than the spacing between the spinnerets of one of the spinning positions. Such a construction of the spinning apparatus makes it likewise possible to combine the filament bundles in several planes.

In one preferred embodiment, each of the spinning positions comprises a separate housing for three serially arranged spinnerets. In the production of multicolored yarns, each spinneret of a spinning position extrudes a filament bundle of a certain color, so that a three-colored yarn can be produced. In the production of unicolored or undyed yarns, the three spinnerets of a spinning position produce each a filament bundle of the same color. In this instance, three yarns are simultaneously produced in each pair of spinning positions. This embodiment is especially advantageous for producing BCF yarns in a corresponding further treatment of the yarns.

The distributor system includes a plurality of distributor pumps, and a valve unit may be provided which interconnects the extruders and the distributor pumps. The valve unit has a plurality of switching positions, which provides the advantage that in the production of a unicolored or an undyed yarn, one spinning position processes the melt of one extruder. With that, it is possible to produce yarns of a great uniformity in their composition.

In one of the switching positions of the valve unit, each spinning position is associated to one extruder. Thus, it is possible to operate the spinning positions in the spinning apparatus with differently dyed filament bundles for producing colored yarns. A special advantage of the invention lies in that the dye changes can be performed in the spinning position rapidly and without great production losses.

In the second switching position of the valve unit, each of the distributor pumps of a spinning position is associated to one of the extruders, so that the spinnerets of the spinning position extrude the polymer melts of a plurality of extruders. In this adjustment, it is advantageous to produce multicolored yarns.

Naturally, the valve unit could also be formed by a known stationary distributor block, which is exchanged for a second distributor block, when need arises. It would also be possible to construct the distributor block with a plurality of plates, so that one plate or a portion of the plates is made exchangeable for changing the melt flow.

A takeup device may be provided which has a plurality of winding positions for winding each of the yarns to a package. In this takeup device, the number of winding positions is greater than the number of the upstream spinning positions. This permits associating one winding position to each spinning position in the production of multicolored yarns. In this instance, the winding positions that are arranged between two adjacent spinning positions, remain inoperative. Only in the production of unicolored yarns, is one package wound in each winding position.

To combine the filament bundles, a yarn treatment device is proposed, which comprises a plurality of treatment stations. The number of the treatment stations is greater than the number of the upstream spinning positions. Thus, a change in the production processes will make is unnecessary to revamp the stations for producing the corresponding number of yarns. In the production of unicolored yarns, each treatment station treats one yarn.

Advantageously, the treatment stations are designed and constructed as texturing nozzles, so that it is possible to produce a crimped yarn.

However, it is also possible to combine the filament bundles within the treatment station by an entanglement nozzle. To produce a crimp in the yarn, the filament bundles are textured before they enter the entanglement nozzles.

The use of the apparatus according to the invention distinguishes itself by its great flexibility in the production of yarns. With the use of the apparatus, it has been accomplished to produce qualitatively superior yarns in a unicolored or multicolored version.

BRIEF DESCRIPTION OF THE DRAWINGS

In the following, further advantages are described with reference to several embodiments and to the attached drawings, in which:

FIGS. 3.1 and 3.2 are schematic views of the controlled melt flow system of an apparatus according to the invention.

DETAILED DESCRIPTION OF THE PREFERRED EMBODIMENT

Figure 1:
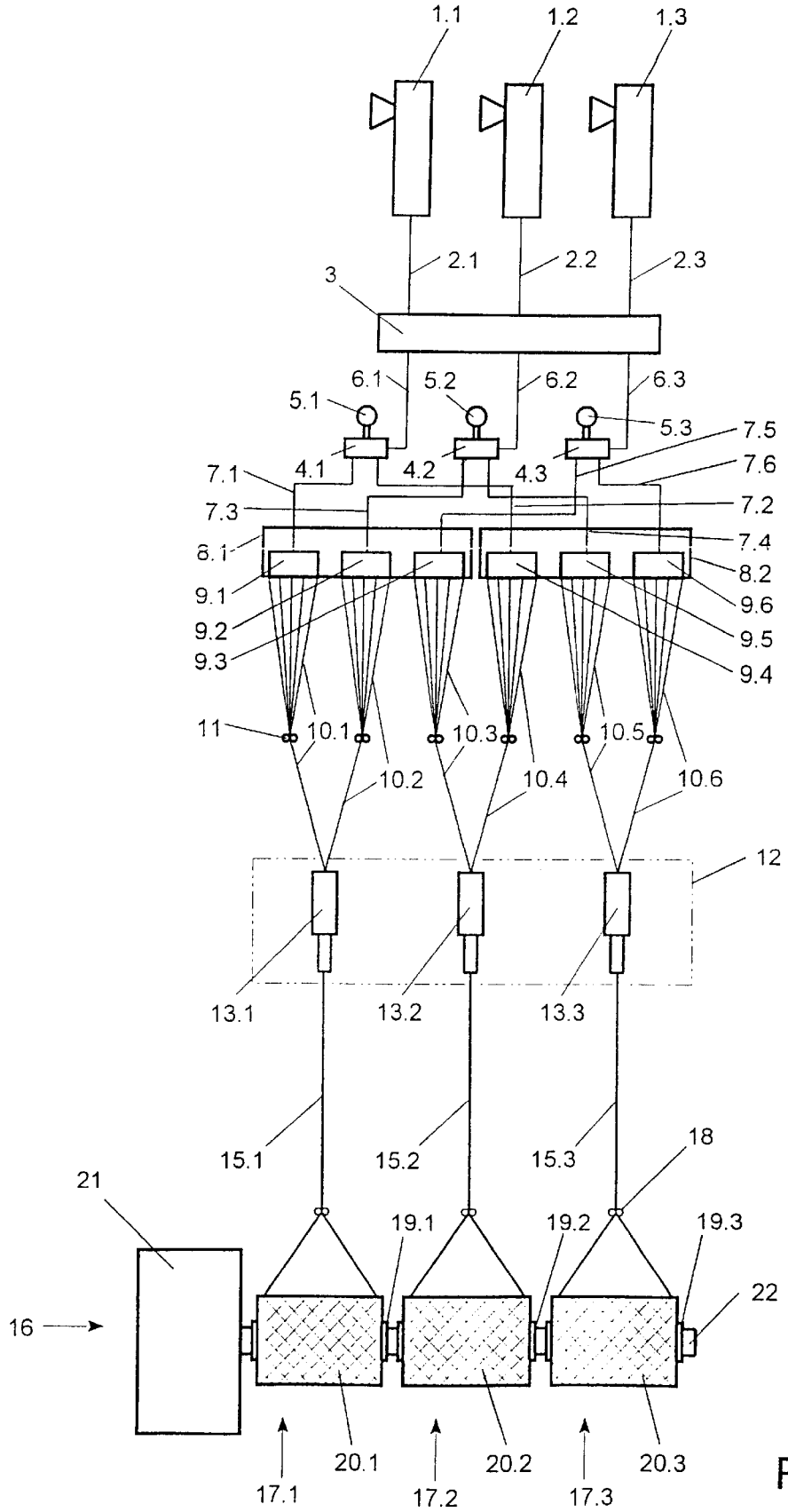
FIG. 1 is a schematic view of a first embodiment of the apparatus according to the invention.

FIG. 1 schematically illustrates a first embodiment of the apparatus according to the invention. To produce a plurality of melt flows of a plastic, extruders 1.1, 1.2, and 1.3 are provided. At its outlet, the extruder 1.1 connects, via a melt line 2.1, to a valve unit 3. Likewise, the extruders 1.2 and 1.3 connect each, via a melt line 2.2 and 2.3, to the valve unit 3. The valve unit 3 will be described in greater detail below, and it possesses three melt outlets which connect respectively, via melt lines 6.1, 6.2, and 6.3, to a distributor pump 4.1, 4.2, and 4.3. The distributor pump 4.1 is controllably driven by a drive 5.1. Likewise, the pumps 4.2 and 4.3 are driven by drives 5.2 and 5.3.

The distributor pumps 4.1, 4.2, and 4.3 are each designed and constructed as two-delivery pumps, so that each pump has two outlets and divides the melt flow supplied through melt line 6 into two equal partial flows. With its first outlet, the distributor pump 4.1 connects, via a distribution line 7.1 to a first spinneret 9.1. The spinneret 9.1 is accommodated in a spinning position 8.1. With its second outlet, the distributor pump 4.1 connects, via a distribution line 7.2, to a spinneret 9.4, which is arranged in a second spinning position 8.2.

The apparatus of FIG. 1 is shown by way of example with two spinning positions 8.1 and 8.2. In practice, as many as eight to ten spinning positions are operated side by side in one apparatus.

The spinning positions 8.1 and 8.2 are separately housed and each comprises three spinnerets. The spinneret 9.2 of the first spinning position 8.1, which is adjacent the spinneret 9.1, connects via a distribution line 7.3 to an outlet of distributor pump 4.2. The third spinneret 9.3 of the spinning position 8.1 connects via a distribution line 7.5 to an outlet of distributor pump 4.3.

The spinnerets 9.1, 9.2, and 9.3 are serially arranged, one after the other, with one of the distributor pumps being associated to each spinneret. The spinnerets 9.4, 9.5, and 9.6 of the second spinning position 8.2. are also connected in series, with the spinning positions 8.1 and 8.2 being mounted in the apparatus in the same plane and at the same height. The spinnerets 9.4, 9.5, and 9.6 of the spinning position 8.2 connect each to one of the pumps via the separately extending distribution lines 7.2, 7.4., and 7.6.

In the case of this spinning position, distributor pump 4.1 is associated to spinneret 9.4, distributor pump 4.2 to spinneret 9.5, and distributor pump 4.3 to spinneret 9.6. Each of the spinnerets 9.1–9.6 produces a filament bundle 10.1–10.6. The filament bundle consists of a plurality of strandlike filaments, which are extruded from the nozzle bores of the spinneret. The filament bundles 10.1–10.6 advance through a cooling zone, so that the filaments of the filament bundles solidify. Subsequently, the individual filaments of the filament bundle 10 are combined via a yarn guide 11, which is followed in the direction of the advancing yarn by a yarn treatment device 12. The yarn treatment device possesses a plurality of work stations, which are each formed by a texturing nozzle 13. In FIG. 1, the yarn treatment device 12 comprises a total of three work stations. A first work station, which is formed by texturing nozzle 13.1, receives the filament bundles 10.1 and 10.2. Inside the texturing nozzle 13.1, the filament bundles 10.1 and 10.2 are compressed to form a common yarn plug. Subsequently, the yarn plug is disentangled to a yarn 15.1. The yarn 15.1 is removed from the plug by a takeup station 16 and wound to a package 20.1 in a winding position 17.1.

In the second treatment station 13.2, the filament bundles 10.3 and 10.4 are combined. The filament bundle 10.3 is produced in the first spinning position 8.1 by spinneret 9.3. The second filament bundle 10.4 is produced in the second spinning position 8.2 by spinneret 9.4. Both filament bundles are combined by texturing nozzle 13.2 to a yarn 15.2. To this end, the spinning positions 8.1 and 8.2 are arranged relative to each other such that the external spinnerets 9.3 and 9.4 are at a distance from each other, which is substantially the same as the spacing that is maintained between the spinnerets of spinning position 8.1 or spinning position 8.2. Thus, it is possible to produce the yarn 15.2 by combining the adjacent filament bundles 10.3. and 10.4 of both spinning positions 8.1 and 8.2 with the same controlled yarn advance as in the adjacent work stations. The yarn 15.2 is wound to a package 20.2 in a winding position 17.2 of takeup station 16.

The third work station is formed by texturing nozzle 13.3. In the texturing nozzle 13.3, the filament bundles 10.5 and 10.6 of spinning position 8.2 are combined to a yarn 15.3. Likewise, in this instance the filament bundles 10.5 and 10.6 are compressed to a yarn plug in the texturing nozzle and subsequently disentangled to the yarn 15.3.

The takeup station 16 comprises a winding position for each work station, so that a total of three winding positions 17.1, 17.2, and 17.3 are provided. For the winding positions 17.1–17.3, the takeup station 16 comprises a long winding spindle 22 mounted in cantilever fashion. The winding spindle 22 is unilaterally supported and can be driven via a drive 21. In each winding position 17.1–17.3, the winding spindle mounts a tube 19.1–19.3, which serves to receive the package. Each yarn 15.1–15.3 advances over a yarn guide 18 to the takeup station 16. To deposit the yarn on the package, a traversing device reciprocates the yarn along the length of the package. An illustration of the traversing device has been omitted.

In the spinning apparatus shown in FIG. 1, additional devices for guiding, drawing, thermally treating, or entangling the yarn may precede or follow the yarn treatment device 12. For example, it is possible to withdraw the filament bundles 10.1–10.6 from the spinnerets 9.1–9.6 by means of a feed system.

FIG. 1 illustrates the use of the apparatus for producing unicolored or undyed yarns. The extruders 1.1, 1.2, and 1.3 produce a unicolored or an undyed polymer melt of a predetermined polymer. Thus, the same polymer melt is supplied via the distributor pumps 4.1, 4.2, and 4.3 to each spinneret of spinning positions 8.1 and 8.2. This causes each spinneret 9.1–9.6 to produce a homogeneous filament bundle. The combination of the filament bundles in the texturing nozzles 13.1, 13.2, and 13.3 thus leads to a yarn that is homogeneous in its composition.

Figure 2:
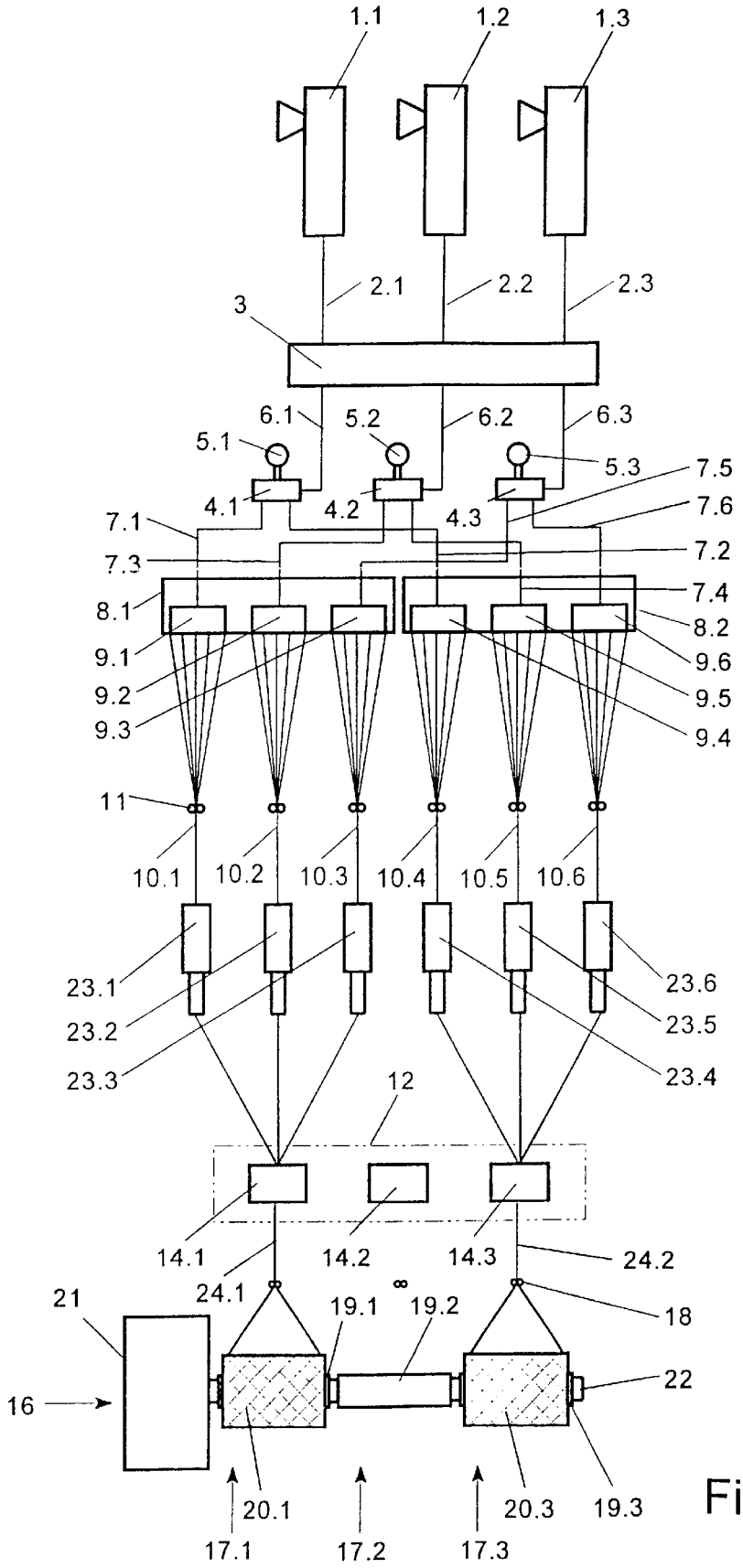
FIG. 2 is a schematic view of a further embodiment of the apparatus according to the invention.

FIG. 2 is a schematic view of a further embodiment of an apparatus according to the invention. The spinning apparatus of FIG. 2, however, differs only in the kind of treatment of the filament bundles as well as in the combination of the filament bundles to yarns. The melt flow control system until the production of the filament bundles is identical with the apparatus of FIG. 1. To this extent the foregoing description is herewith incorporated by reference.

In the spinning apparatus shown in FIG. 2, a plurality of texturing nozzles 23.1–23.6 are arranged side by side between the takeup station 16 and the spinning positions 8.1 and 8.2. For each spinneret 9.1–9.6 of spinning positions 8.1 and 8.2, a texturing nozzle 23.1–23.6 is arranged in the yarn advance plane of the produced filament bundles 10.1–10.6. Between the texturing nozzles 23.1–23.6 and the takeup station 16, the yarn treatment device 12 is arranged for combining the filament bundles. The yarn treatment device comprises a total of two work stations, which are each formed by an entanglement nozzle 14.1, 14.2, and 14.3.

In the situation shown in FIG. 2, the apparatus is used to produce a multicolored yarn. To this end, a melt of a certain color is produced in each of the extruders 1.1, 1.2, and 1.3. Via the valve unit 3, the melt flow of an extruder is supplied to one of the distributor pumps 4. Thus, for example, the extruder 1.1 may connect to distributor pump 4.1, the extruder 1.2 to distributor pump 4.2, and the extruder 1.3 to distributor pump 4.3. Each distributor pump now carries a differently colored polymer melt. Through the distribution lines 7.1–7.6, the distribution of the partial melt flows occurs such that in each spinning position 8.1 and 8.2 three differently colored filament bundles are produced. The filament bundles 10.1 and 10.6 advance each through a texturing nozzle. In so doing they are compressed to a plug and subsequently disentangled to a crimped filament bundle. The crimped filament bundles 10.1, 10.2, and 10.3 of one spinning position 8.1 are then combined in the entanglement nozzle 14.1 to a yarn 24.1. In the winding position 17.1 of takeup station 16, the yarn 24.1 is wound to a package 20.1. After texturing by the entanglement nozzle 14.3, the filament bundles 10.4, 10.5, and 10.6 of the second spinning position 8.2 are combined to a yarn 24.2. The yarn 24.2 is wound in the winding position 17.3 of the takeup station 16 to a package 20.3. The center work station of the yarn treatment device 12 as well as the center winding position 17.2 of the takeup station 16 remain idle. In the production of multicolored yarns, it is advantageous to produce one yarn per spinning position, so that the work station and the winding station respectively remain out of operation. However, it is also possible to provide yarn treatment devices and winding stations in the production of multicolored yarn with the number of work stations and winding positions, which corresponds to the number of spinning positions. Likewise, it is possible to provide a treatment device and winding position for each spinneret of a spinning position.

FIGS. 3.1 and 3.2 schematically illustrate an embodiment of a controlled melt flow system in the spinning apparatus of the present invention. In these Figures, an illustration of the combination as well as further treatment of the filament bundles and the yarn has been omitted. FIG. 3.1 illustrates the controlled melt flow system in the production of multicolored yarns. FIG. 3.2 shows the controlled melt flow system in the production of unicolored or undyed yarns. Unless otherwise specified, the following description will apply to both Figures.

For the production of the polymer melts, two extruders 1.1 and 1.2 are provided. At their outlet, the extruders 1.1 and 1.2 connect, via melt lines 2.1 and 2.2, to a valve unit 3. The valve unit 3 is manually adjustable and can be adjusted between two switching positions. Through the valve unit 3, the melt lines 2.1, and 2.2 are connected according to one of the switching positions to melt lines 6.1, 6.2, 6.3, and 6.4. The melt lines 6.1–6.4 connect respectively each to the inlet of a distributor pump 4.1–4.4. Thus, the melt line 6.1 extends to distributor pump 4.1, the melt line 6.2 to distributor pump 4.3, the melt line 6.3 to distributor pump 4.2, and the melt line 6.4 to distributor pump 4.4. The distributor pumps 4.1–4.4 are each designed and constructed as a two-delivery pump, so that they comprise two outlets. The melt flow is divided by the distributor pump 4 into two partial flows, and delivered via the respective pump outlets to the thereto connected distribution lines 7.1–7.8. The distributor pumps 4.1–4.4 supply, via distribution lines 7.1–7.8, a total of four spinning positions 8.1–8.2, each having two spinnerets 9. This results in an apparatus, which comprises four side-by-side spinning positions 8.1–8.4 with the spinnerets 9.1–9.8. In each of the spinnerets 9.1–9.8, a filament bundle 10.1–10.8 is produced. The association of the distributor pumps to the spinning positions provides that the distributor pumps 4.1 and 4.2 supply the spinning positions 8.1 and 8.2. In this connection, the spinneret 9.1 of spinning position 8.1 and the spinneret 9.3 of spinning position 8.2 are associated to distributor pump 4.1. The spinneret 9.2 of spinning position 8.1 and the spinneret 9.4 of spinning position 8.2 are associated to distributor pump 4.2. Accordingly, the supply to spinning positions 8.3 and 8.4 occurs in like manner by distributor pumps 4.3 and 4.4, so that the two spinnerets of a spinning position are each associated to one distributor pump.

FIG. 3.1 shows the valve unit 3 in its switching position I. In this position, the melt flow from extruder 1.1 advances to distributor pumps 4.1 and 4.3. The melt flow from extruder 1.2 advances to distributor pumps 4.2 and 4.4. With that, it is realized that each spinning position 8.1 and 8.4 produces a filament bundle from the melt flow of extruder 1.1, and a filament bundle from the melt flow of extruder 1.2. This controlled melt flow system is thus in particular suitable for producing multicolored yarns. In this process, the extruder 1.1 produces, for example, a melt dyed blue, and the extruder 1.2 a melt dyed yellow. Thus, the spinning positions 8.1–8.4 produce each a blue and a yellow filament bundle, which are combined to a blue-yellow yarn.

In the situation shown in FIG. 3.2, the valve unit is in its switching position II. In this switching position, the melt flow of extruder 1.1 advances to the distributor pumps 4.1 and 4.2. The melt flow of the extruder 1.2 advances to the distributor pumps 4.3 and 4.4. With that, it is accomplished that the spinning positions 8.1 and 8.2 process only the melt of extruder 1.1, and the spinning positions 8.3 and 8.4 only the melt of extruder 1.2. This controlled melt flow system is especially suited for producing unicolored or even undyed yarns. In this process, it is possible to produce in the spinning positions 8.1 and 8.2, for example, two blue yarns, and in the spinning positions 8.3 and 8.4 two yellow yarns.

The valve unit shown in FIGS. 3.1–3.2 may also be used without difficulty in a spinning apparatus of FIG. 1 or 2. To this end, the spinning apparatus of FIG. 1 or 2 is enlarged by four spinning positions. In this instance, two spinning positions each would be supplied by three distributor pumps. Accordingly, in one of the switching positions of the valve unit, one extruder melt line would be associated to a total of three distributor pumps. The valve unit 3 would thus have three connections for the extruders and nine connections for the distributor pumps. If one looked now at the apparatus shown in FIG. 1, the valve unit 3 would be in this instance in a switching position, in which the distributor pumps 4.1, 4.2, and 4.3 are simultaneously supplied by the extruder 1.1. The melt flows from the extruder 1.2 and 1.3 would be supplied to the adjacent spinning positions.

In the spinning apparatus shown in FIG. 2, the valve unit would advantageously be accommodated in a switching position, in which the distributor pump 4.1 is associated to extruder 1.1, the distributor pump 4.2 to extruder 1.2, and the distributor pump 4.3 to extruder 1.3.

The apparatus of the present invention is in particular suited for producing BCF yarns, for example, from polyester, polyamide, or polypropylene.

The apparatus shown in FIGS. 1, 2, 3.1 and 3.2 are by way of example. The apparatus of the present invention may also be constructed with a plurality of spinning positions, which comprise each only one spinneret, and which are supplied by only one extruder. In such a spinning apparatus, it is thus possible to spin from the filament bundle one yarn per spinning position, or to spin one yarn from two filament bundles by combining two adjacent spinning positions. With that, a great flexibility is accomplished in the production of the yarns.

What is claimed is:

1. A melt spinning apparatus for producing a plurality of multifilament yarns comprising at least one extruder for producing a polymer melt flow, at least two separately housed spinning positions arranged side by side, with each spinning position including at least two spinnerets, a distributor system for delivering a portion of the melt flow to each spinneret of each spinning position and such that each spinneret extrudes a filament bundle composed of a plurality of strandlike filaments, and wherein the adjacent spinning positions are arranged side by side in such a manner that at least one filament bundle of one spinning position can be combined to form a yarn with at least one filament bundle of an adjacent spinning position.

2. The melt spinning apparatus as defined in claim 1 wherein the at least two spinnerets of each of said spinning positions are serially aligned, and the spinnerets of adjacent spinning positions are serially aligned.

3. The melt spinning apparatus as defined in claim 2 wherein the at least two spinnerets of each spinning position have a predetermined spacing, and wherein the spacing between a spinneret arranged at an edge of one spinning position and an adjacent spinneret of an adjacent spinning position is not significantly greater than the predetermined spacing.

4. The melt spinning apparatus as defined in claim 1 wherein the spacing between a spinneret arranged at an edge of one spinning position and an adjacent spinneret of the adjacent spinning position is less than the spacing between the at least two adjacent spinnerets of the spinning positions.

5. The melt spinning apparatus as defined in claim 1 wherein the at least two spinning positions each comprise three serially aligned spinnerets, so that the adjacent spinning positions extrude a total of six filament bundles which may be selectively combined to produce two yarns by combining three filament bundles of each spinning position or three yarns by combining two filament bundles from different spinning positions.

6. The melt spinning apparatus as defined in claim 1 wherein the apparatus comprises at least two extruders, wherein the distributor system includes a plurality of distributor pumps, and wherein the extruders and the distributor pumps are interconnected by a valve unit which has a plurality of switching positions (I, II), so that in one of the switching positions (II) of the valve unit the distributor pumps associated with the spinning positions connect to one of the extruders, so that all of the spinnerets of each of the spinning positions extrude the polymer melt of one of the extruders.

7. The melt spinning apparatus as defined in claim 6 wherein in a second switching position (I) of the valve unit, one of the extruders is associated to each of the distributor pumps of the spinning positions so that at least two of the spinnerets of each spinning position respectively extrude the polymer melts of each of the extruders.

8. The melt spinning apparatus as defined in claim 7 wherein the valve unit is manually actuated.

9. The melt spinning apparatus as defined in claim 1 further comprising a takeup device with a plurality of winding positions for winding each of the yarns to a package, and wherein the number of winding positions is greater than the number of the spinning positions.

10. The melt spinning apparatus as defined in claim 1 further comprising a yarn treatment device having a plurality of treatment stations for combining the filament bundles to one or more yarns, and wherein the number of treatment stations is greater than the number of spinning positions.

11. The melt spinning apparatus as defined in claim 10 wherein the treatment stations are each in the form of a texturing nozzle.

12. The melt spinning apparatus as defined in claim 10 wherein the treatment stations are each in the form of an entanglement nozzle.

13. A method for producing a plurality of multifilament yarns, comprising the steps of extruding a polymeric melt to produce a melt flow, distributing a portion of the melt flow to each of at least two separately housed spinning positions which are arranged side by side, with each spinning position including at least one spinneret to which the melt flow is delivered and such that each spinneret of each spinning position extrudes a filament bundle composed of a plurality of strandlike filaments, and combining at least one filament bundle of one of the spinning positions with at least one filament bundle of an adjacent spinning position to form a composite yarn, and winding the composite yarn into a package.

14. A method for producing a plurality of multifilament yarns comprising the steps of extruding a polymeric melt from each of at least two extruders to produce at least two melt flows, providing a plurality of spinning positions with each spinning position including at least two spinnerets, guiding the melt flows through a valve unit and to the spinning positions, with the valve unit being moveable between a first switching position (I) wherein the melt flow of each of the extruders is delivered to at least one spinneret of each spinning position and a second switching position (II) wherein the melt flow of each of the extruders is delivered to all of the spinnerets of at least one of the spinning positions.

15. The method as defined in claim 14 wherein the melt flows are of different colors.

16. A melt spinning apparatus for producing a plurality of multifilament yarns comprising at least two extruders for producing a polymer melt flow, at least two spinning positions arranged side by side, with each spinning position including at least one spinneret, a distributor system for delivering a portion of the melt flow to each spinneret of each spinning position and such that each spinneret extrudes a filament bundle composed of a plurality of strandlike filaments, wherein the adjacent spinning positions are arranged side by side in such a manner that at least one filament bundle of one spinning position can be combined to form a yarn with at least one filament bundle of an adjacent spinning position, and wherein the distributor system includes a plurality of distributor pumps, and wherein the extruders and the distributor pumps are interconnected by a valve unit which has a plurality of switching positions (I, II), so that in one of the switching positions (II) of the valve unit the distributor pumps associated with the spinning positions connect to one of the extruders, so that all of the spinnerets of each of the spinning positions extrude the polymer melt of one of the extruders.

17. The melt spinning apparatus as defined in claim 16 wherein in a second switching position (I) of the valve unit, one of the extruders is associated to each of the distributor pumps of the spinning positions so that at least two of the spinnerets of each spinning position respectively extrude the polymer melts of each of the extruders.

18. The melt spinning apparatus as defined in claim 17 wherein the valve unit is manually actuated.

* * * * *